US006890112B2

(12) United States Patent
Kline

(10) Patent No.: US 6,890,112 B2
(45) Date of Patent: May 10, 2005

(54) METHOD AND SYSTEM FOR HANDLING A LINERLESS LABEL WEB

(75) Inventor: James Richard Kline, Dayton, OH (US)

(73) Assignee: Paxar Americas, Inc., Miamisburg, OH (US)

( * ) Notice: Subject to any disclaimer, the term of this patent is extended or adjusted under 35 U.S.C. 154(b) by 15 days.

(21) Appl. No.: 10/266,060

(22) Filed: Oct. 7, 2002

(65) Prior Publication Data

US 2004/0067088 A1 Apr. 8, 2004

(51) Int. Cl.[7] ..... B41J 11/26

(52) U.S. Cl. ..... 400/615.2; 400/611; 400/612; 400/613; 400/621; 400/641; 400/662; 101/66; 101/288; 101/420; 101/421; 428/42.2; 428/137; 428/202; 428/211.1; 428/43; 156/277; 156/384

(58) Field of Search ..... 156/277, 384; 400/611–613, 621, 641, 662; 101/66, 288, 420, 421; 428/42.2, 137, 202, 211.1, 43

(56) References Cited

U.S. PATENT DOCUMENTS

| | | | | | |
|---|---|---|---|---|---|
| 3,312,005 | A | * | 4/1967 | McElroy | 40/638 |
| 4,214,024 | A | * | 7/1980 | Jacobson | 428/42.2 |
| 4,457,981 | A | * | 7/1984 | Jenkins | 428/42.2 |
| 5,267,800 | A | * | 12/1993 | Petteruti et al. | 400/88 |
| 5,336,541 | A | * | 8/1994 | Kobayashi | 428/41.8 |
| 5,351,426 | A | * | 10/1994 | Voy et al. | 40/638 |
| 5,378,301 | A | * | 1/1995 | Boreali et al. | 156/344 |
| 5,497,701 | A | * | 3/1996 | Uland | 101/288 |
| 5,531,853 | A | * | 7/1996 | Cubow et al. | 156/521 |
| 5,833,377 | A | * | 11/1998 | Keller et al. | 400/208 |
| 6,022,050 | A | * | 2/2000 | Kline | 283/81 |
| 6,231,922 | B1 | | 5/2001 | Kline | |
| 6,585,437 | B1 | * | 7/2003 | Wiklof et al. | 400/621 |

FOREIGN PATENT DOCUMENTS

| | | |
|---|---|---|
| EP | 0 579 430 | 1/1994 |
| WO | WO 96/10489 | 4/1996 |

OTHER PUBLICATIONS

Linerless Addendum, Monarch Marking Systems, Inc., 1998.

* cited by examiner

*Primary Examiner*—Andrew H. Hirshfeld
*Assistant Examiner*—Andrea H. Evans
(74) *Attorney, Agent, or Firm*—Joseph J. Grass

(57) ABSTRACT

There is disclosed a linerless label web roll wherein the label web has a patterned coating of pressure sensitive adhesive on its underside between marginal side edges and at marginal side edges of the label web. The adhesive is provided in longitudinally extending laterally spaced stripes of adhesive with intervening adhesive-free zones. The label web can be supported and/or guided by support or guide elements which contact the adhesive-free zones in a suitable utilization device such as a printer or label applicator.

12 Claims, 2 Drawing Sheets

METHOD AND SYSTEM FOR HANDLING A LINERLESS LABEL WEB

BACKGROUND OF THE INVENTION

1. Field of the Invention

This invention relates to linerless pressure sensitive adhesive-backed label webs and to method and system for handling linerless, pressure sensitive adhesive-backed label webs.

2. Brief Description of the Prior Art

The following prior art is made of record: U.S. Pat. No. 4,457,981 to William A. Jenkins; U.S. Pat. No. 5,267,800 to Petteruti; U.S. Pat. No. 5,497,701 to David M. Uland; U.S. Pat. No. 5,833,377 to Keller et al; U.S. Pat. No. 6,022,050 to James R. Kline; and LINERLESS ADDENDUM, 1998 Monarch Marking Systems, Inc.

In handling linerless, pressure sensitive adhesive-backed label webs, it is frequently required to guide or support a strip of the label web. A guide or support may be disposed anywhere along a web path for the label web. The guide or support may be stationary or movable. The sticky, pressure sensitive adhesive may catch on or stick to the guide or support so as to be detrimental to the reliable, unimpeded, smooth advance of the label web.

SUMMARY OF THE INVENTION

It is a feature of the invention to provide an improved linerless, pressure sensitive adhesive-backed label web and an improved method of handling such a web and to a system which includes the improved web.

According to a specific embodiment of the method of the invention, a printer having a print head, a platen roll cooperable with the print head, and a support having a plurality of longitudinally extending laterally extending laterally spaced support elements disposed adjacent the platen roll. A linerless label web having a printable outer side and any underside having a plurality of longitudinally extending laterally spaced stripes of pressure sensitive adhesive, with a longitudinally extending adhesive-free zone between adjacent adhesive stripes, is also provided. The adhesive-free zones are aligned with the support elements, and the outer side of the web is printed upon.

The invention is used in or for a system, wherein there is a support along a web path, the support having a plurality of laterally spaced support elements. The system includes a linerless label web having a printable outer side and an underside having a plurality of longitudinally extending laterally spaced stripes of pressure sensitive adhesive. The label web is disposed along the web path. There is a longitudinally extending adhesive-free zone between adjacent adhesive stripes. The adhesive-free zones are aligned with the support elements. The support elements contact and support the printed web at the adhesive-free zones. The support can be used in a label applicator which does not include a printer. The invention is even useful to support the linerless label web upstream of a print head and a cooperable platen roll. The invention is applicable to an environment wherein the support simply supports or guides the linerless label web.

A specific embodiment of the linerless label web of the invention includes a printable linerless label web wound into a roll, wherein the label web includes a longitudinally extending web of label material having an upper side and an underside, the web having marginal side edges, laterally extending laterally spaced apart stripes of pressure sensitive adhesive on the underside of the web between the marginal side edges, adjacent adhesive stripes being spaced apart by an adhesive-free zone to provide an alternating pattern of adhesive stripes and intervening adhesive-free zones, the upper side having an outer surface comprised of a release coating, and the web being wound into a roll.

BRIEF DESCRIPTION OF THE DIAGRAMMATIC DRAWINGS

DETAILED DESCRIPTION OF THE PREFERRED EMBODIMENTS

Figure 1:
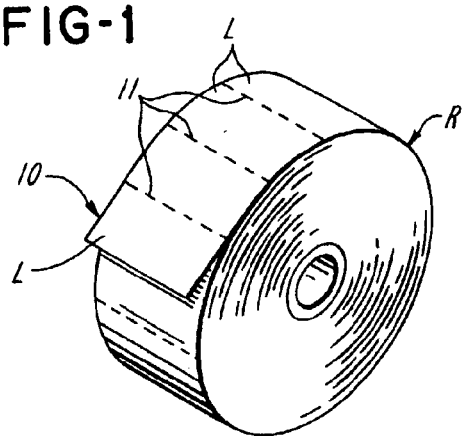
FIG. 1 is a perspective view of a linerless pressure sensitive adhesive-backed label web wound into a roll.

With reference to FIG. 1, there is shown a roll R of a wound, linerless, pressure sensitive adhesive-backed label web 10. The web 10 is shown to be divided into a series of end-to-end labels L by longitudinally spaced, transversely or laterally extending lines of weakening 11 formed for example by perforating, creasing or the like. The lines of weakening 14 can be omitted, if desired.

Figure 2:
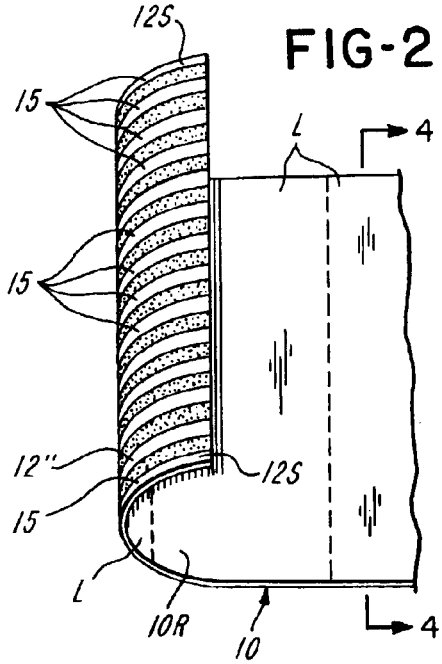
FIG. 2 is a fragmentary perspective view of the label web shown in FIG. 1, with the label web being shown curled to expose its underside.
Figure 3:
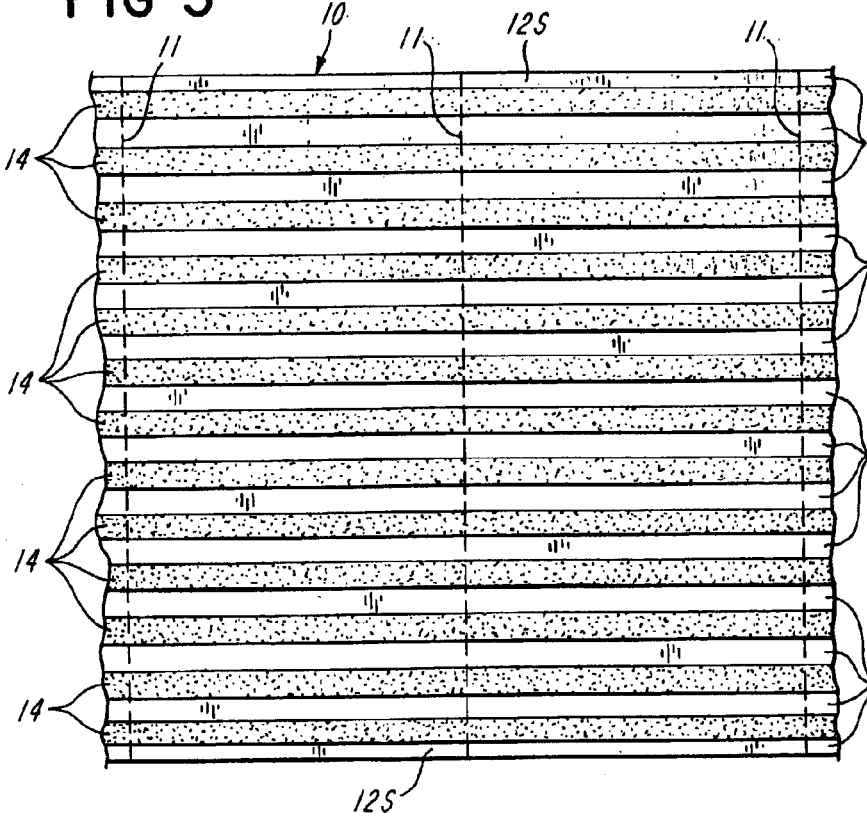
FIG. 3 is a bottom plan view of the label web shown in FIGS. 1 and 2.
Figure 4:
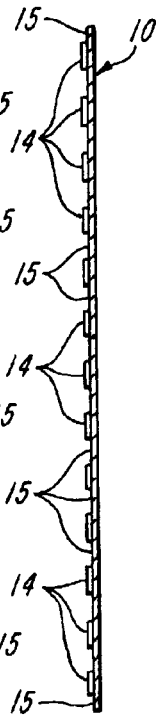
FIG. 4 is a sectional view taken generally along line 4—4 of FIG. 2.
Figure 5:
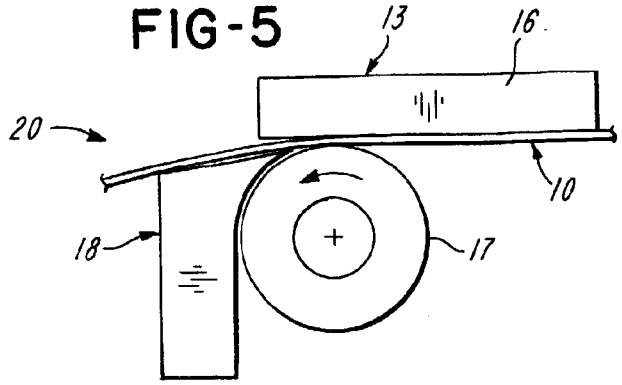
FIG. 5 is a diagrammatic side elevational view of a system including a printer and the linerless label web.

With reference to FIG. 2, the label web 10 is shown in greater detail. The label web 10 is comprised of a web of label material 12 composed of any suitable material such as paper, fabric, or a synthetic material. The outer surface of the upper side 12' of the label material 10 is preferably coated with a thermal coating 10T so that the labels L can be imaged in a thermal printer generally indicated at 13 (FIGS. 5 through 8). A release coating 10R such as for example the release coating disclosed in U.S. Pat. No. 6,022,050 overlies the thermal coating 10T so that the thermal coating is disposed between the label material 12 and the release coating 10R. An optional conventional barrier coating 10B can also be used between the release coating 10R and the thermal coating 10T.

In the event it is desired to use thermal transfer printing for example, rather than thermal direct printing as described above, the thermal coating 10T and the barrier coating 10B can be eliminated and the release coating 10R can be applied directly to the upper surface 12' of the label material 12. Then a thermal transfer ribbon can be positioned between the print head 16 and the label web 10. This is, however, not the usual preferred method because in thermal transfer printing the ink from the thermal transfer ribbon sometimes does not adhere so well to the release coating.

The underside 12" of the label material 12 is pattern-coated with longitudinally extending, parallel, transversely spaced stripes or zones of pressure sensitive adhesive 14. The adhesive 14 can be of any desired tackiness or adhesivity. Adjacent stripes of adhesive 14 are spaced apart by a longitudinally extending adhesive-free or tack-free area or zone 15. As shown for example in FIGS. 2, 3, 4, 6, 7 and 8, the adhesive stripes 14 are laterally spaced apart by the adhesive-free zones 15. One or both of the marginal side edges 12S of the label web have adhesive-free zones as well.

With reference to FIGS. 5 through 8, the label web 10 is shown to move in a path passing between a thermal print head 16 and a roll 17 illustrated to be a platen roll which cooperates with the print head 16. The platen roll 17 is coated with and/or contains a material such as silicone so that the adhesive 14 on the underside of the label web 10 does not adhere to the platen roll 17. As the label web 10 is advanced past or to a position downstream of the print head 16 and platen roll 17, the label web 10 passes or slides onto a support generally indicated at 18. The support 18 supports the label web 10 as shown in the drawings.

Figure 6:
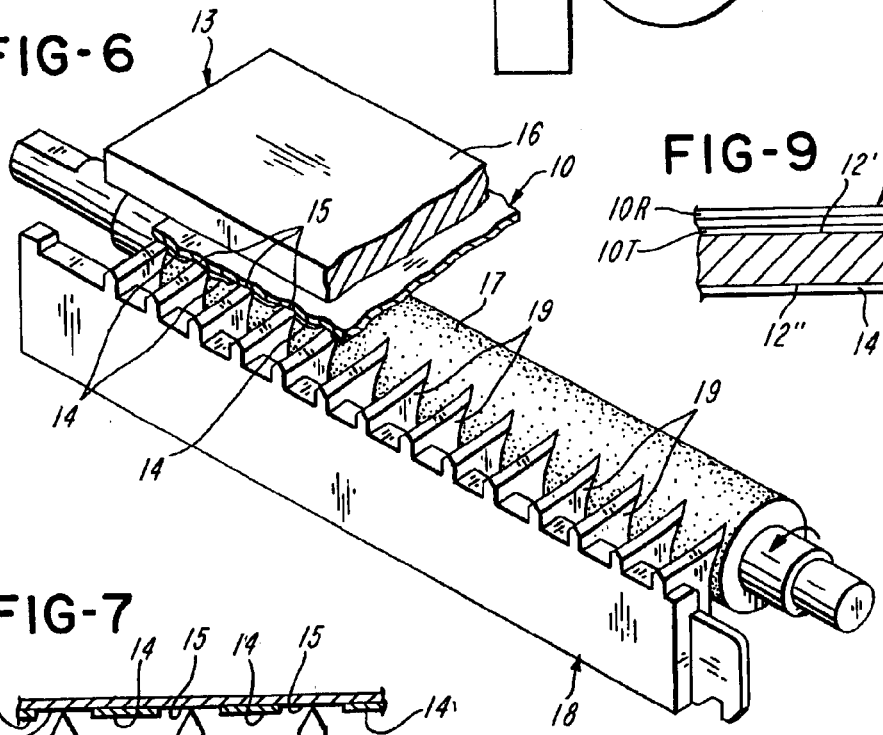
FIG. 6 is a perspective view of the system shown in elevation in FIG. 5.
Figure 9:
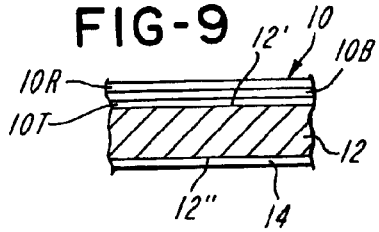
FIG. 9 is a sectional view of the label web taken along line 9—9 of FIG. 8.
Figure 7:
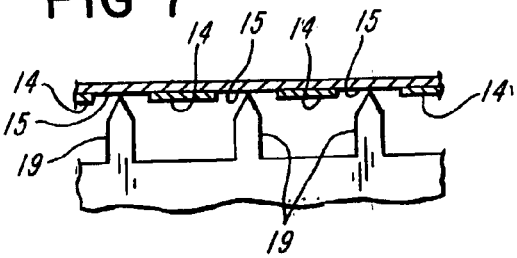
FIG. 7 is a fragmentary front elevational view showing a support and the label web which are also shown in FIGS. 5 and 6.
Figure 8:
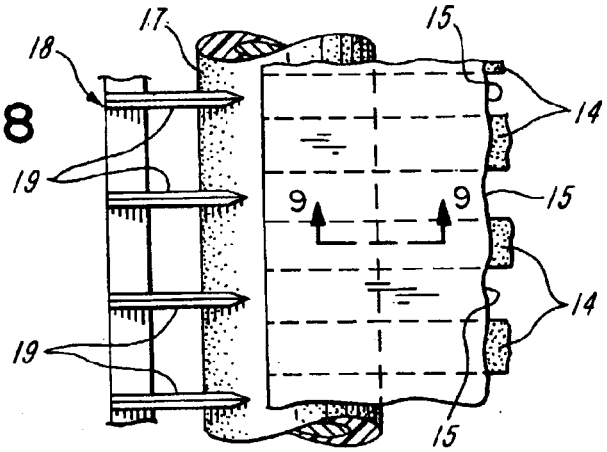
FIG. 8 is a fragmentary top plan view of the support, the label web and a platen roll.

The support 18 is shown in greater detail in FIGS. 6, 7, and 8 as having a series of laterally spaced apart support elements 19 adjacent the platen roll 17.

The printer 13 is shown in greater detail in prior art U.S. Pat. No. 5,833,377 the disclosure of which is incorporated herein by reference. The support 18 is shown in prior art LINERLESS ADDENDUM 1998 Monarch Marking Systems, Inc. and referred to as a "shelf" represents a later development related to the printer of U.S. Pat. No. 5,833, 377. Therefore, the printer 13 depicted in FIGS. 5 through 8 modified by the support or shelf is prior art and is also incorporated herein by referece. The printer 13 as thus modified was used in the prior art to handle linerless, pressure sensitive adhesive-backed label web where the coating of adhesive was continuous except perhaps on the marginal side edges and the adhesive was supported directly on and by the support elements. The adhesive would stick to the support elements and would offer resistance or drag to the free advance of the label web.

As shown in FIGS. 6, 7 and 8, the adhesive-free zones 15 are aligned with the parallel support elements 19 so that no adhesive ever touches the elements 19. Therefore, not only are the elements 19 kept free of adhesive, but the label web 10 cannot stick to the support elements 19.

It is noted that the adhesive-free zones are matched to the spacing of the support elements 19. In that the support elements 19 are equally spaced as is preferred, the adhesive-free zones 15 are likewise equally spaced. The printer 13 can have a greater or lesser number of support elements 19, and should be adequate in number and spacing for their intended purposes, so long as only the adhesive-free zones contact the support elements. It is preferred that there be at least three stripes of adhesive 14 spaced apart by adhesive-free zones 15.

The printer 13 in combination with the label web 10 is considered to constitute a system 20 for handling linerless, pressure sensitive adhesive-backed label webs.

The roll 17 is preferably driven as by an electric motor (not shown) to advance the label web 10 along its path of movement.

The invention has been illustrated together with a printer 13 wherein the support 18 is disposed downstream of a print head 16 and platen roll 17. However, a support such as the support 18 can be positioned upstream of the print head 16 and platen roll 17 if the patterned label web 10 needs supporting between the roll R and the print head 16 and the platen roll. Also, the invention is also useful in a label application which advances the linerless label web 10 by supporting or guiding the label web 10 along its path, even though the label applicator does not include a printer. Such a support would however, also have support elements which are aligned with adhesive-free zones on the label web 10.

In setting up the printer 13, the roll R is positioned in the printer 13 so that the adhesive-free zones are aligned with the support elements as best shown in FIGS. 6, 7 and 8. As the label web 10 is unwound from the roll R, the label web 10 passes between the print head 16 and the platen roll 17. From there the label web 10 slides onto and is supported by elements 19 which support the label web 10.

The label web 10 is illustrated as having thirteen adhesive stripes 14 and fourteen adhesive-free zones 15. The web 10 can be narrower than the width of the support 18 so that there are fewer adhesive stripes. Even in the web 10 illustrated in FIGS. 3 and 4 one or both adhesive-free side edges 12S can be eliminated, if desired, in which event the marginal side edge or edges would have a stripe of adhesive up to the side edge of the label web 10. Also, the web 10 can be wider than illustrated in which case one or both of the marginal side edges can have adhesive stripes up to the side edge or edges of the label web.

The order of the steps recited in the method claims is not critical and is not to be considered as limiting.

The expressions print, printable, printed and printing used herein are not limited to thermal imaging but are broadly intended to include other types of imaging processes and apparatus including, but not limited to, electrostatic, impact, offset and photographic.

Other embodiments and modifications of the invention will suggest themselves to those skilled in the art, and all such of these as come within the spirit of this invention are included within the scope as best defined by the appended claims.

What is claimed is:

1. Method of handling a linerless label web, comprising: providing a support having a plurality of laterally spaced support elements, providing a linerless label web having a printable release-coated outer side and an underside having a plurality of longitudinally extending laterally spaced stripes of pressure sensitive adhesive, there being a longitudinally extending adhesive-free or tack-free zone between adjacent adhesive stripes, aligning the adhesive-free or tack-free zones with the support elements, and advancing the label web with the support elements in supporting contact with the label web at the adhesive-free or tack-free zones while the web is unsupported at the adhesive stripes between the support elements.

2. Method of handling a linerless label web, comprising: providing a printer having a print head, a platen roll cooperable with the print head, and a support having a plurality of laterally spaced support elements disposed adjacent the platen roll, providing a linerless label web having a printable release-coated outer side and an underside having a plurality of longitudinally extending laterally spaced stripes of pres- sure sensitive adhesive, there being a longitudinally extend- ing adhesive-free or tack-free zone between adjacent adhesive stripes, aligning the adhesive-free or tack-free zones with the support elements wherein the support elements contact the web at only the adhesive-free or tack-free zones, printing on the outer side of the web and wherein the support elements support the web downstream of the place where printing occurs.

3. Method as defined in claim 2, wherein the underside of the label web has an adhesive-free or tack-free zone at at least one marginal side edge.

4. Method as defined in claim 2, wherein the underside of the web has an adhesive-free or tack free zone at each marginal side edge.

5. Method as defined in claim 2, wherein the support elements are elongate in the longitudinal direction and support the printed web.

6. Method as defined in claim 2, wherein the web has thirteen adhesive stripes.

7. A system for handling a linerless label web, comprising: a printer having a print head, a platen roll, and a support along a web path, the support having a plurality of laterally spaced support elements, a linerless label web having a printable release-coated outer side and an underside having a plurality of longitudinally extending laterally spaced stripes of pressure sensitive adhesive, the label web being disposed along the web path, there being a longitudinally extending adhesive-free or tack-free zone between adjacent adhesive stripes, wherein the adhesive-free or tack-free zones are aligned with the support elements, and wherein the support elements contact and support the web at only the adhesive-free or tack-free zones.

8. A system as defined in claim 7, wherein the support is disposed along the web path downstream of the print head and platen roll.

9. A system as defined in claim 7 wherein the platen roll is driven and advances the label web from between the print head and the platen onto the support.

10. A system as defined in claim 7, wherein the label web is advanced from between the print head and platen roll onto the support.

11. In or for a system for handling linerless label webs, a support along a web path, the support having a plurality of laterally spaced support elements, a linerless label web having a printable release-coated outer side and an underside having a plurality of longitudinally extending laterally spaced stripes of pressure sensitive adhesive, the label web being disposed along the web path, there being a longitudinally extending adhesive-free or tack-free zone between adjacent adhesive stripes, wherein the adhesive-free or tank-free zones are aligned with the support elements, and wherein the support elements contact and support the web at only the adhesive-free or tack-free zones.

12. In or for a system as defined in claim 11, a roll for advancing the label web.

* * * * *

UNITED STATES PATENT AND TRADEMARK OFFICE

CERTIFICATE OF CORRECTION

PATENT NO. : 6,890,112 B2
DATED : May 10, 2005
INVENTOR(S) : Kline

It is certified that error appears in the above-identified patent and that said Letters Patent is hereby corrected as shown below:

Column 4,
Lines 54 through 67 should not be indented.
Line 59, “pres- sure” should be -- pressure --.
Line 60, “extend- ing” should be -- extending --.

Column 6,
Line 17, “tank-” should be -- tack- --.

Signed and Sealed this

Seventh Day of March, 2006

JON W. DUDAS
*Director of the United States Patent and Trademark Office*